US005628413A

United States Patent [19]

Lu et al.

[11] Patent Number: 5,628,413

[45] Date of Patent: May 13, 1997

[54] MODULAR DISPLAY STAND

[75] Inventors: Hong-lin Lu, Fullerton; Hsing-min Keng, Palos Verde Estate, both of Calif.; Louis B. Kremer, Newport, R.I.

[73] Assignee: Jimway, Inc., Bell, Calif.

[21] Appl. No.: 531,102

[22] Filed: Sep. 20, 1995

[51] Int. Cl.[6] ..... A47F 7/00

[52] U.S. Cl. ..... 211/13.1; 211/26; 211/163; 211/189

[58] Field of Search ..... 211/189, 163, 211/13, 26, 131

[56] References Cited

U.S. PATENT DOCUMENTS

| | | | |
|---|---|---|---|
| 1,408,128 | 2/1922 | Neahr | 211/26 |
| 1,426,156 | 8/1922 | Dinsen et al. . | |
| 1,554,818 | 9/1925 | Greenstreet . | |
| 1,704,953 | 3/1929 | Schockett et al. . | |
| 1,732,131 | 10/1929 | Mahaffey . | |
| 2,950,155 | 8/1960 | Schick | 211/163 X |
| 3,034,657 | 5/1962 | Newmyer et al. . | |
| 3,420,381 | 1/1969 | Bradfield . | |
| 3,606,020 | 9/1971 | Kern . | |
| 3,666,113 | 5/1972 | Burell et al. . | |
| 3,756,421 | 9/1973 | Wilkins | 211/163 |
| 3,756,422 | 9/1973 | Ostring et al. | 211/163 |
| 3,917,072 | 11/1975 | Bleed . | |
| 4,609,975 | 9/1986 | Badolato et al. . | |
| 4,895,260 | 1/1990 | Ancona et al. . | |
| 5,318,259 | 6/1994 | Fussler . | |

OTHER PUBLICATIONS

Murray Feiss Catalog, One Page, Dated Jul. 1994.
Home Lighting & Accessories Catalog, dated Apr. 1993.

*Primary Examiner*—Robert W. Gibson, Jr.
*Attorney, Agent, or Firm*—Poms, Smith, Lande & Rose, P.C.

[57] ABSTRACT

A modular display stand for holding a plurality of lighting products is disclosed. The modular display stand is constructed from a plurality of modular units, each modular unit having two panels joined at a common edge to form a V-shape. The panel includes apertures for mounting the lighting products and a power strip for supplying electricity to the lighting products. The modular units are arranged so that one panel of a modular unit overlaps the panel of a second modular unit, wherein the overlapping panels are joined by a fastener. This arrangement is repeated so that the joined, complementary panels extend radially. Each modular unit can optionally be connected end-to-end or mounted against a wall, floor, or ceiling.

21 Claims, 4 Drawing Sheets

MODULAR DISPLAY STAND

BACKGROUND OF THE INVENTION

1. Field of the Invention

The present invention relates to display stands. More precisely, the present invention relates to a modular display stand for holding a plurality of lighting products wherein the display stand can be arranged into a variety of different configurations.

2. Prior Art and Related Information

The present invention is directed to display stands. The utility of such a device is apparent in their ability to promote the features and functions of any product. The common display stand is constructed from a base, a vertical member extending therefrom, with a variety of support racks.

For example, U.S. Pat. No. 3,917,072 to Bleed discloses an upright revolving display rack having a plurality of vertically elongated display panels disposed in angularly spaced relation and brought into view by revolving the rack about an upright axis. The foldable frame structure, and the panels are divided into separate panel sections which can be disassembled to fit in a short flat package.

Display racks have also been designed for special duties. U.S. Pat. No. 3,606,020 to W. Kern discloses a rack for electronic modules. The rack is arranged to support a plurality of electronic component modules in an array which provides maximum accessibility to the side panels of each module. U.S. Pat. No. 3,034,657 to L. M. Newmyer et al. discloses a rack for displaying a plurality of articles such as bottles. U.S. Pat. No. 4,609,975 to Badolato et al. discloses an eyeglass display case including a first module having a central axis and including a plurality of radially extending, circumferentially spaced compartments, the compartments defining a plurality of radially extending compartments therebetween. Badolato also includes a lighting system to illuminate the carousel-type display case. U.S. Pat. No. 3,420,381 to W. S. Bradfield discloses a relay rack for mounting multiple banks of electrical components in a frame.

A specialized field has developed for displaying lighting related devices or products. For example, U.S. Pat. No. 1,704,953 to H. U. Schockett et al. discloses a display device that supports a plurality of lighting fixtures in such a way that each fixture can be moved into position directly above an opening in the ceiling of the display room and which provides a mechanism for lowering the fixture through the opening until it projects downwardly from the ceiling in the same manner as when it is actually installed. The device includes a support, a rotatable member secured to the support, a plurality of arms extending radially from the rotatable member and a mechanism for securing a fixture to each of the arms. The lighting fixtures are wired to an electrical source and an electric motor is used to rotate the arms.

U.S. Pat. No. 1,426,156 to T. Dinsen et al. discloses a display stand for electric lamps comprising a fixed display frame, members thereon for receiving lamps, a pair of terminals on said frame for connection to a source of electricity, and manually operable means whereby one of said members without changing its position may be connected to the pair of terminals independent of the other members to enable or disable the operation of the lamps.

U.S. Pat. No. 3,666,113 to Burrell et al. discloses a holder for light bulbs made of a generally rectangular, plastic foam board having a plurality of cavities which open through one surface thereof and are adapted to receive light bulb holding screw sleeve devices. The sleeve devices are friction fitted within the cavities. More mundane methods of displaying light fixtures include simply hanging the fixtures from the ceiling or attachment of the light fixtures to a wall.

in general, the foregoing conventional techniques are unsatisfactory due to their rather primitive, complicated, and inflexible construction. Many cannot be quickly adapted in the field to accept more or fewer lamps or lighting fixtures, or be rearranged to change their appearances. Any desire by a salesperson, for example, to rearrange the lighting fixture set-up entails complicated disassembly, rewiring, and reassembly of the wall or ceiling component supporting the lighting fixtures. Furthermore, transporting such bulky, complicated hardware that does not break down into smaller components for travel across the country from trade show to trade show is a serious disadvantage. Hence, there is a need for a modular display stand for holding a plurality of lighting products, wherein the display stand can be re-configured and modified quickly and easily in the field.

SUMMARY OF THE INVENTION

It is therefore an object of the present invention to provide a modular display stand for holding a plurality of lighting products that can be easily re-arranged into alternative configurations to display lighting products in many ways. It is another object of the present invention to provide a modular display stand that can increase its surface area or vice-versa by adding to or decreasing the number of modular components in order to increase or decrease the overall surface area to allow more or fewer lighting fixtures to be displayed. It is yet another object to provide a modular display stand that can be easily assembled or disassembled in the field to facilitate use in trade shows. It is still yet another object of the present invention to provide a modular display stand that can simultaneously demonstrate numerous products yet not occupy much space.

To accomplish the foregoing, the present invention is directed to a modular display stand for holding a plurality of lighting products comprising a first modular unit having at least two panels joined by a hinge to form a V-shape, a second modular unit having at least two panels joined by a hinge to form a V-shape, wherein at least one of the panels of the first modular unit overlaps one of the panels of the second modular unit to form a compartment therebetween. A plurality of apertures are formed in the panels for mounting the lighting products. A fastener joins together the overlapping panels and a power source, such as a power strip, is preferably mounted inside one of the modular units, and supplies the electric power to the lighting products.

When the modular units are joined together, they form radially out-stretched wings much like the hands of a clock face. In the preferred embodiment, the flat panels provide a tremendous amount of surface area on which to mount lighting products such as lighting fixtures, lamp covers, decorative light bulbs, etc. The compartments preferably contain the lamp fixture mounting hardware, electrical wiring, and the power strip.

A top panel and a bottom panel can optionally be added to the modular display stand. These panels, aside from adding structural rigidity to the display stand, provide more surface area for mounting additional lighting products.

In a preferred embodiment, the overlapping panels are held together by use of VELCRO® strips. In particular, the outer exposed edges of the overlapping panels are covered with a strip of the loop complement of the VELCRO® strip.

A side panel that can simultaneously overlie those contiguous edges includes a strip of the hook complement of the VELCRO® strip. Accordingly, the side panel attaches to the contiguous edges of the overlapping panels by engagement of the hook complement to the loop complement. The two overlapping panels are thus held together, and can be called a wing.

In the present invention, it is possible to increase or decrease the pairings of the modular units to obtain a display stand having one wing up to as many wings as can fit in a 360° circle, as determined by the thickness of each panel joined together to form each wing. Furthermore, the panels not joined together and left open can be attached to a wall, a ceiling, or any smooth surface.

Accordingly, the present invention has many advantages. First, the present invention utilizes a simple construction for easy assembly and disassembly. Second, the present invention can be easily modified in the field into a large variety of configurations for displaying an unlimited number of different lighting products. Third, it is possible to quickly increase the surface area available in the present invention in order to make room to install and display larger numbers of lighting products. Fourth, use of a minimal number of modular components and simple construction ensure that the present invention is inexpensive to build and use.

DESCRIPTION OF THE DRAWINGS

The objects, features and advantages of the present invention will be apparent to one skilled in the art from reading the following description in which:

FIG. 3(*b*) is a detailed perspective view of a modular unit exposing the hinge hardware on which the two panels pivot.

FIG. 4(*b*) shows a four-wing unit;

FIG. 4(*c*) shows a five-wing unit;

FIG. 4(*d*) shows a one-wing unit attached to a flat surface; and

FIG. 4(*e*) shows two three-wing units interconnected at a common wing.

DETAILED DESCRIPTION OF THE INVENTION

The following specification describes a modular display stand for holding a plurality of lighting products. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

The present invention is directed to a modular display stand for holding and displaying a plurality of lighting products comprising of a first modular unit having at least two panels joined by a hinge to form a V-shape, a second modular unit having at least two panels joined by a hinge to form a V-shape, wherein at least one of the panels of the first modular unit overlaps one of the panels of the second modular unit to form a compartment therebetween. One or more apertures are provided in at least one of the panels for mounting the lighting products thereto. A fastener is used to join the overlapping panels securing the two panels together. A power source, such as an A/C power strip, is disposed inside the compartment and is used to supply energy to the lighting products when needed. The lighting products are mounted to the apertures and their wires are passed therethrough and eventually connect with the A/C power strip.

Figure 1:
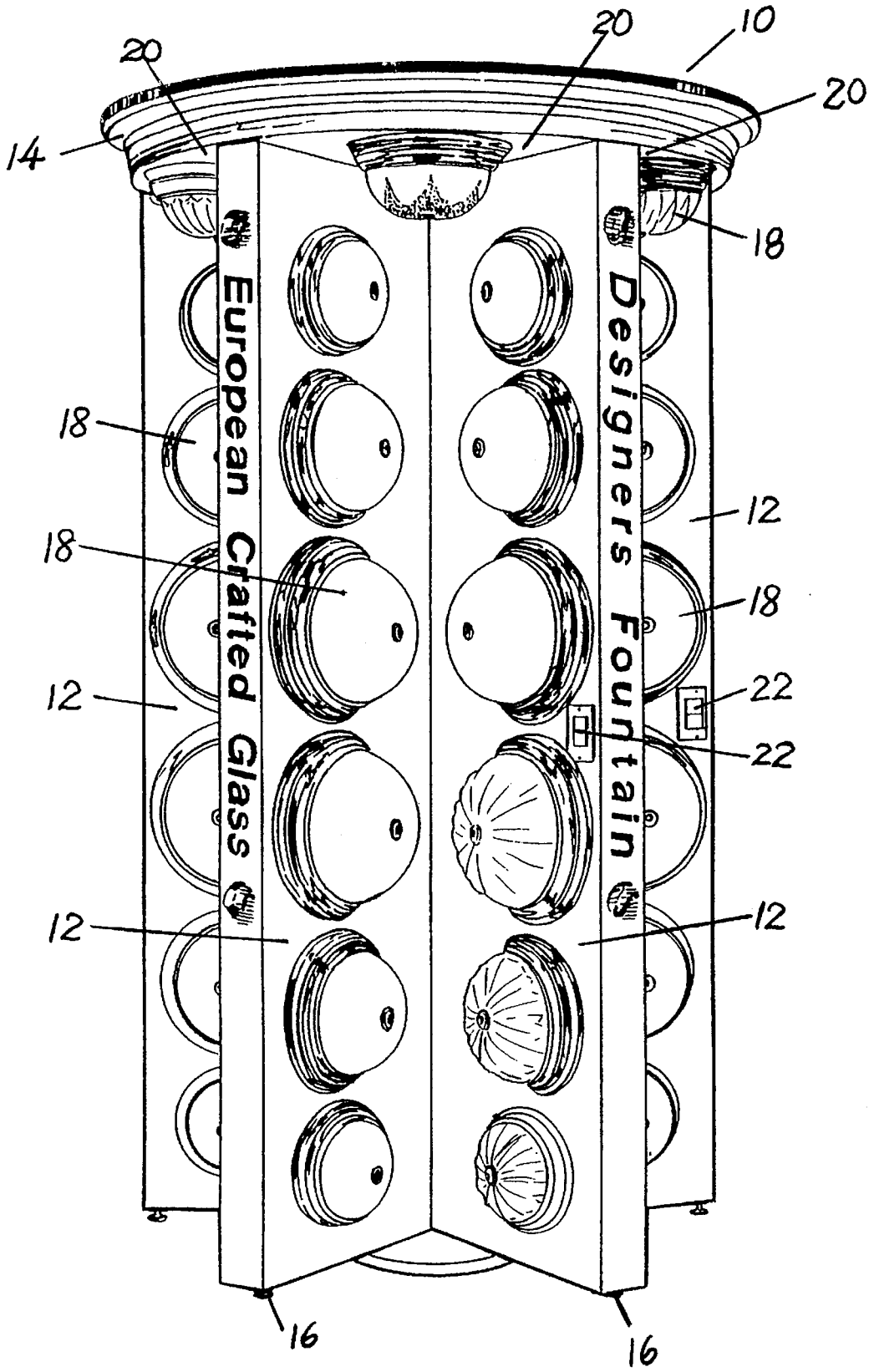
FIG. 1 is a perspective view of a preferred embodiment of the present invention modular display stand for holding a plurality of lighting products.

In a preferred embodiment, shown in FIG. 1, the modular display stand 10 has a plurality of wings 12 extending radially similar to the hands on a clock face. The exemplary embodiment shown in FIG. 1 also includes an optional circular top panel 14. At the bottom of the display stand 10, the present invention includes adjustable feet 16 extending from the bottom of the wings 12 that stabilize the entire structure.

The present invention modular display stand 10 is used preferably for displaying lighting products such as lamps and lighting fixtures 18 as shown in FIG. 1. The lighting fixtures 18 are disposed on the flat surfaces of the wings 12 and spaced apart in any desirable manner. As seen in FIG. 1, the underside surface 20 of the circular top panel 14 can also be used to mount lighting fixtures 18. As a result, the present invention is highly space-efficient and can display a variety of lamps, lighting fixtures, etc. within a small volume.

The lighting fixtures 18 are powered by electricity and the present invention includes electrical switches 22 that control the illumination of the lamps and lighting fixtures 18. The switches can be any type know in the art including rocker switches, dimmer switches and the like.

Although the present invention modular display stand 10 is shown with lighting fixtures 18, it is contemplated that the present invention can be used to display and demonstrate other lighting products including bulbs, florescent tubes, neon tubes, lampshades, lamp covers, sconce lamps, spot lights, reflectors, chandeliers, etc.

Figure 2:
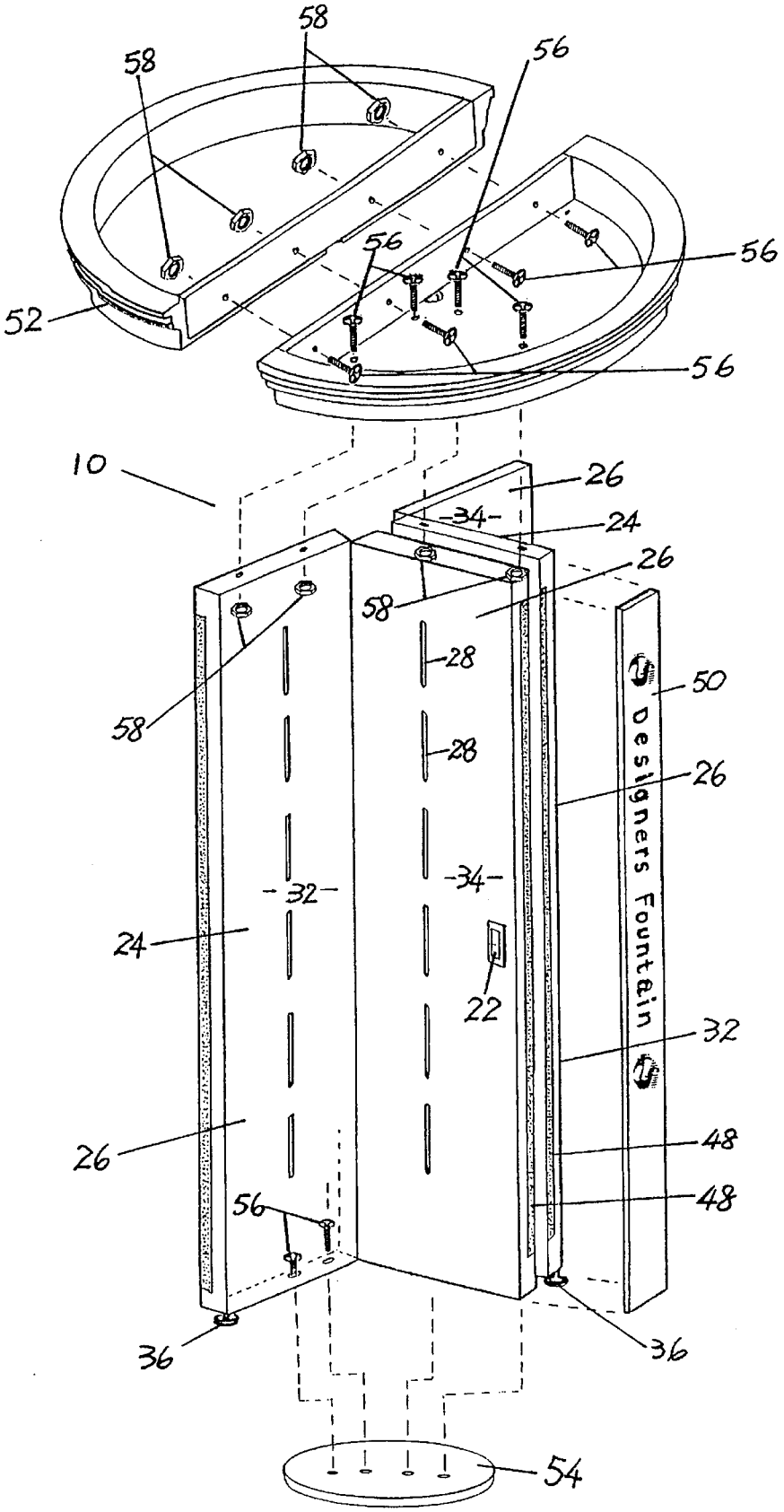
FIG. 2 is an exploded view of a preferred embodiment of the present invention having two modular units assembled to form one wing.

The modular display stand 10 shown in FIG. 1 is comprised of a plurality of modular units 24 shown in FIG. 2. The illustration of FIG. 2 depicts two modular units 24, wherein each modular unit 24 is comprised of preferably flat panels 26 that are joined at common ends to form a V-shape. In fact, FIG. 3(*a*) provides a perspective view of a single, preferred embodiment, modular unit 24. Each flat panel 26 has a hollowed interior and has a structure similar to a dresser drawer with a perimeter wall 30 defining the outer edges of the flat panel 26.

One or more apertures 28 of any size or shape are formed in the flat panels 26 in order to mount the lighting fixtures 18. Of course, the positioning of the apertures and their number can be adjusted to the specific application.

Moreover, in an alternative embodiment, not shown, the panels can be contoured or tiered so that their surface has unique shapes in order to angle the lighting fixtures if necessary. In the alternative embodiment, the panels can further be constructed with openings, recesses, or depressions to mount lighting fixtures that may be recessed or retracted into the panel to simulate, for example, sconce lighting.

Figure 3A:
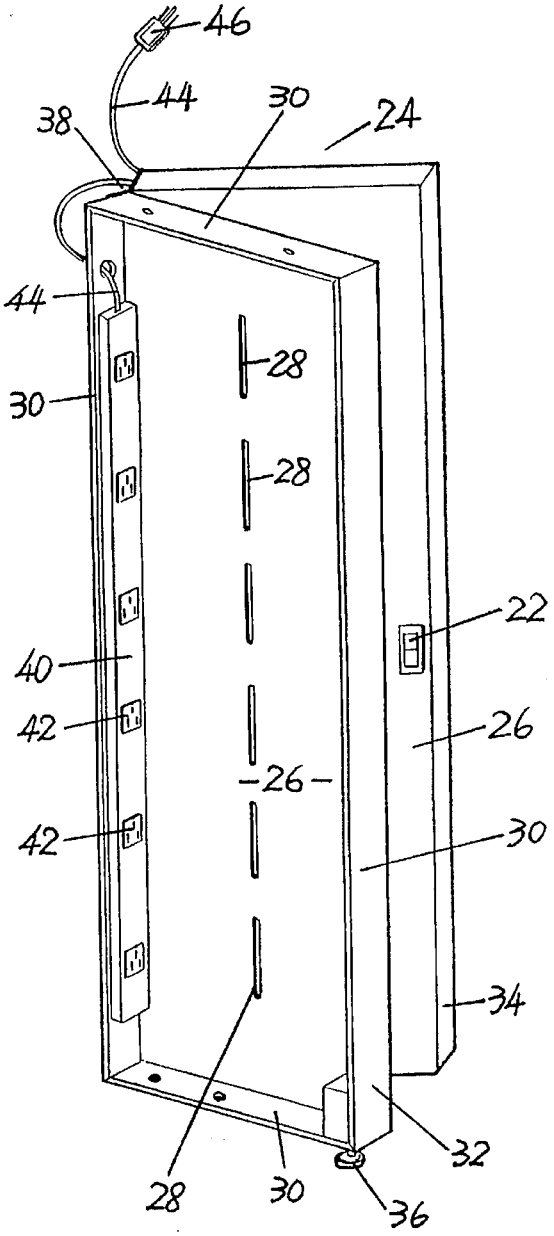
FIG. 3(*a*) is a detailed perspective view showing a preferred embodiment modular unit with a power strip.
Figure 3B:
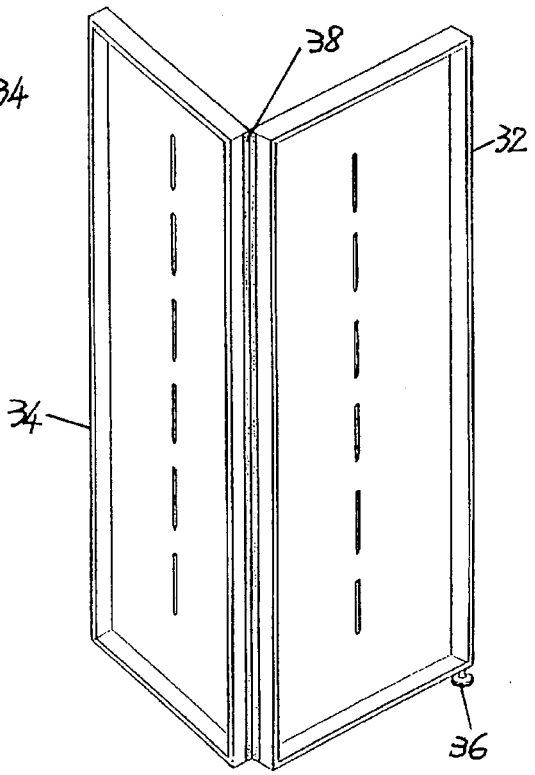
Figure 4A:
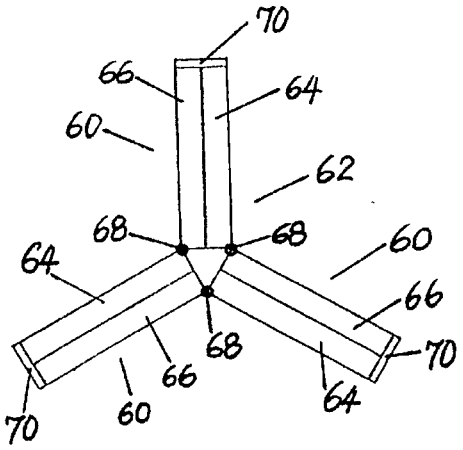
FIG. 4(*a*) shows a three-wing unit.
Figure 4B:
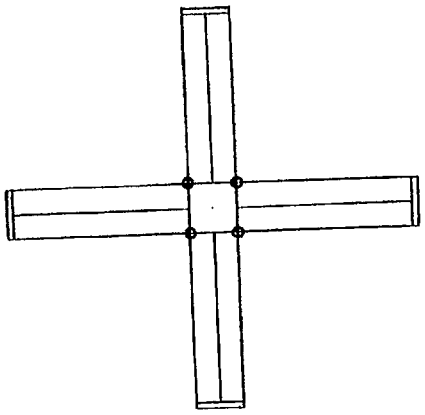
Figure 4C:
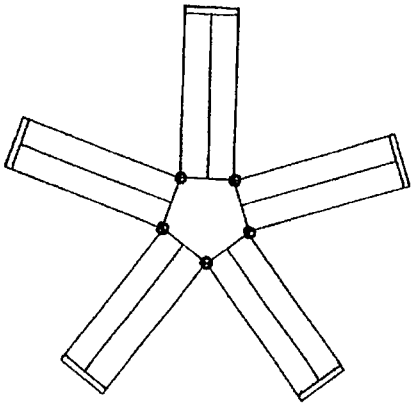
Figure 4D:
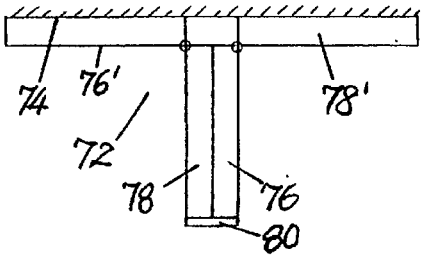
Figure 4E:
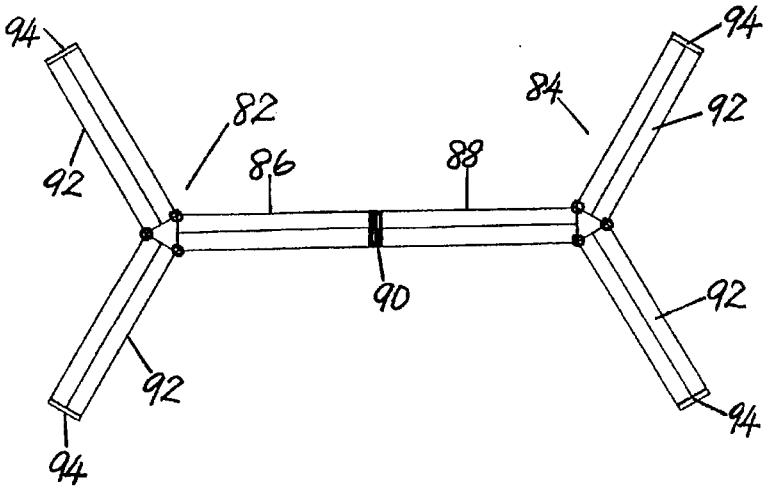

Each preferred embodiment modular unit 24 has a support panel 32 and a complementary, opposing open panel 34. The support panel 32 includes feet 36 that support both panels 32, 34. The support panel 32 is attached to the open panel 34 by use of a hinge 38, such a piano wire hinge known in the art. FIG. 3(*b*) better illustrates the hinge 38 and the support panel 32 and open panel 34. The open panel 34 freely swings on hinge 38 while the support panel 32 is propped up by feet 36. The feet 36 can be optionally adjusted for height and their number and locations varied as desired.

FIG. 3(*a*) further illustrates an optional power source 40 which in the exemplary embodiment is an A/C power strip having a plurality of sockets 42 and a main lead wire 44 with a plug 46. The plug 46 then connects to any available A/C outlet commonly found in buildings. In an alternative embodiment, the power source 40 can be, of course, a battery.

There is sufficient room defined by the flat panel 26 and perimeter wall 30 to contain wiring for the lighting fixture lamps and the ballast for any florescent tube type lighting devices. Other electrical hardware can be hidden in this area too. An electrical switch 22 is disposed on one of the panels 32, 34. In the preferred embodiment, each modular unit 24 includes a switch 22 and a power source 40.

As seen in FIG. 2, two modular units 24 have been assembled such that the open panel 24 of one modular unit is mated to the support panel 32 of the other modular unit. Because the overlapping panels 32, 34 have preferably comparable size and shape, their corresponding perimeter walls 30 align and engage to form a compartment therebetween.

The complementary panels 32, 34 are held together by a fastener. In the preferred embodiment, VELCRO® type hook and loop fasteners are used. Specifically, two strips of the loop portion are bonded or attached to an outer edge of the respective panels 32, 34. An optional side panel 50 includes a strip of the complementary hook portion of the VELCRO® fastener. The side panel 50 is then pressed against the outer edges of the panels 32, 34 thereby joining the loop portion to the hook portion of the VELCRO® fastener. In this manner, the support panel 32 is bound to the open panel 34.

The side panel 50 also serves to cover the seam between the overlapping panels 32, 34. It is possible to decorate the side panel 50 as shown in FIGS. 1 and 2 with any appropriate design.

Of course, it is possible to join the support panel 32 to the open panel 34 by using other methods known in the art. For example, metal or plastic clasps, wing nuts, screws, tape, magnets, plastic or metal snaps, weak adhesives, hooks with eyelets, etc. With use of VELCRO® strips, it is clear that assembly and disassembly of the display rack is quick and simple.

As mentioned earlier, the weight of the modular units 24 is supported by feet 36 which tend not to skid laterally. The feet 36 can be of any conventional design and can optionally be threaded to provide some level of vertical adjustment. The feet 36 may also be retracted into the support panel 32 for shipping.

The present invention also includes optional top and bottom panels 52, 54. The top and bottom panels can be fastened using screws and nuts 56, 58 as shown or by other means known in the art, such as VELCRO®, double stick tape, wing nuts, staples, glue, etc. In the preferred embodiment, the top panel 52 is made in two discrete halves for easy break-down and shipment, but it may be formed from a single sheet of material if necessary. The top and bottom panel 52, 54 provide additional surface area in order to add more lighting fixtures 18 if necessary. The panels 52, 54 also increase the rigidity and stability of the finished modular display stand 10 if the need arises.

It is clear that by increasing or decreasing the number of modular units, it is possible to configure the modular display stand into a variety of different shapes and arrangements. Indeed, FIGS. 4(*a*) through 4(*e*) illustrate a variety of possible configurations based on the present invention. FIG. 4(*a*) shows a three wing configuration of the present invention modular display stand 62. Each wing 60 is comprised of a complementary pairing of a support panel 64 with an open panel 66. As seen in the plan view of FIG. 4(*a*), each V-shaped modular unit has a hinge 68 interconnecting the support panel 64 to the open panel 66. Side panels 70 hold the complementary panels 64, 66 together.

The number of wings 60 can be increased to as many as can physically fit within a 360° circle, which is a function of the thickness of the wings and the individual panels. For example, FIG. 4(*b*) is a plan view of a four wing construction while FIG. 4(*c*) is a five wing construction. Obviously, as the thickness of each panel decreases, it is possible to increase the number of wings by decreasing the angle between adjacent wings. Therefore, it is clear that there can be more or fewer wings than that shown in the drawings of FIG. 4.

In FIG. 4(*d*), the present invention modular display stand 72 is mounted to a flat surface 74, wherein the flat surface 74 is a wall, floor, ceiling, or the like. The display stand 72 can be physically attached to the flat surface 74, be simply abutting it, or be free standing. Again, the modular display stand 72 is comprised of, in this exemplary embodiment, two modular units each having a support panel 76 and an open panel 78. A side panel 80 is used to hold together the complementary support panel 76 and open panel 78, while the unpaired panels 76', 78' are mounted to the flat surface 74. The present invention contemplates any method known in the art to mount the panels 76', 78' to the flat surface 74, including use of VELCRO®, mechanical fasteners, bonding agents, tape, etc.

FIG. 4(*e*) is a plan view of yet another alternative embodiment of the present invention wherein two modular units 82, 84 are connected by their respective wings 86, 88 in an end-to-end fashion. Preferably, a VELCRO® fastener 90 is used to join the two modular units 82, 84, but other means known in the art can be used too.

The free or unattached wings 92 have side panels 94 holding the complementary panels together to form the wing in the same manner as described above. It is, of course, contemplated that any side panel 94 can be replaced with another VELCRO® fastener so that yet another modular unit can be joined to a free wing 92.

It should be clear that the present invention modular display stand can be comprised of any combination of different numbers of modular units arranged in many different layouts. To recapitulate, the number of wings can be increased or decreased from that shown in FIGS. 4(*a*)–4(*c*). The present invention modular display stand can be adapted to mount to a flat surface as shown in FIG. 4(*d*). Furthermore, the modular units can be joined to each other as shown in FIG. 4(*e*). A free wing can be joined to a flat surface or wall if needed or to another modular unit in order to build a network.

It is understood that various changes and modifications of the preferred embodiments described above are apparent to those skilled in the art. Such changes and modifications can be made without departing from the spirit and scope of the present invention. It is therefore intended that such changes and modifications are covered by the following claims.

What is claimed is:

1. A modular display stand for holding a plurality of lighting products comprising:

a first modular unit having at least two panels joined by a hinge to form a V shape;

a second modular unit having at least two panels joined by a hinge to form a V shape, wherein at least one of the panels of the first modular unit overlaps one of the panels of the second modular unit to form a compartment;

an aperture formed in one of the panels for mounting the lighting products;

a fastener joining the overlapping panels; and a power source disposed on the first modular unit, connected to the lighting products.

2. The modular display stand of claim 1, wherein:

the two panels of the first modular unit includes an open panel and a support panel;

the two panels of the second modular unit includes an open panel and a support panel;

the modular display stand further comprises a third modular unit having an open panel and a support panel joined by a hinge to form a V shape, wherein the open panel of the second modular unit overlaps the support panel of the first modular unit, and the support panel of the second modular unit overlaps the open panel of the third modular unit; and wherein the overlapping panels form compartments therebetween and are joined by a plurality of fasteners.

3. The modular display stand of claim 2, wherein the support panel of the third modular unit overlaps the open panel of the first modular unit and the overlapping panels are joined by a fastener.

4. The modular display stand of claim 2, wherein the modular display stand further comprises:

a fourth modular unit having at a support panel and an open panel joined by a hinge to form a V shape, wherein the open panel of the fourth modular unit overlaps the support panel of the third modular unit, and the support panel of the fourth modular unit overlaps the open panel of the first modular unit, wherein the overlapping panels form compartments therebetween; and a plurality of fasteners interconnecting the overlapping panels.

5. The modular display stand of claim 1, wherein the power source includes an electrical outlet.

6. The modular display stand of claim 1, wherein the display stand further comprises a top panel mounted to a top surface of the display stand and having at least one aperture therein.

7. The modular display stand of claim 1, wherein the fastener further comprises complementary patches of hook and loop means wherein patches of the loop means are disposed on respective overlapping panels and one patch of hook means attaches thereto.

8. The modular display stand of claim 1, wherein the display stand further comprises a circular top panel attached to the top of the display stand, a circular bottom panel attached to a bottom of the display stand, and wherein the panels have a rectangular shape.

9. The modular display stand of claim 1, wherein the panels further comprise feet that extend from a bottom surface of the panels.

10. The modular display stand of claim 1, wherein the display stand further comprises a bottom panel disposed on a underside of the panels.

11. A modular lighting fixture display stand for displaying a lighting product comprising:

at least two modular units, each including two panels having an outer edge and an inner edge wherein the inner edges of the two panels are hinged together, and wherein at least the two modular units are joined so that one pair of the panels overlap to form a compartment;

a fastener interconnecting the overlapping panels;

an aperture located in one of the panel, wherein the lighting product is mounted to the aperture; and a power source, disposed on one of the panels, connected to the lighting product.

12. The modular lighting fixture display stand of claim 11, wherein the display stand further comprises four modular units each having an outer edge and an inner edge, wherein the inner edges of the two panels are hinged together, and the four modular units include a first pair of overlapping panels forming a compartment and a second pair of overlapping panels forming another compartment, and wherein the first and second overlapping panels are further joined at the outer edges.

13. The modular lighting fixture display stand of claim 11, wherein the power source includes an electrical power strip.

14. The modular lighting fixture display stand of claim 11, wherein the power source includes at least one electrical switch disposed on one panel.

15. The modular lighting fixture display stand of claim 11, wherein the lighting product includes light fixtures.

16. The modular lighting fixture display stand of claim 11, wherein the panels include a hollow interior.

17. The modular lighting fixture display stand of claim 1 I, wherein the display stand further comprises a first and second modular unit, the first and second modular units each further comprising a support panel and an open panel, wherein the support panel of the first modular unit is joined to the open panel of the second modular unit, and wherein the open panel and the support panel of the first and second modular units are attached to a wall.

18. A lighting product display stand comprising:

a plurality of outward extending wings, each wing comprising a pair of complementary, overlying panels forming compartments;

at least one fastener interconnecting the pair of complementary, overlying panels;

a hinge pivotally connecting two adjacent panels that are not overlying;

an aperture located in one of the panels, wherein the lighting product is mounted to the aperture; and a power source disposed on a panel within at least one compartment, connected to the lighting product.

19. The lighting product display stand of claim 18, wherein the display stand includes five outward extending wings, each wing comprising of a pair of complementary, overlying panels forming a compartment and having an aperture therethrough, and at least one fastener interconnecting the pair of overlying panels, and wherein the lighting product is contained within the compartment and mounted to the aperture.

20. The lighting product display stand of claim 18, wherein the hinge includes piano wire.

21. The lighting product display stand of claim 18, wherein the display stand further comprises valance panels having hook and loop fasteners interconnecting the overlapping panels.

* * * * *